US007345427B2

(12) United States Patent
Henninger et al.

(10) Patent No.: US 7,345,427 B2
(45) Date of Patent: Mar. 18, 2008

(54) LAMP AND LIGHTING UNIT WITH INTERFERENCE COATING AND BLOCKING DEVICE FOR IMPROVED UNIFORMITY OF COLOR TEMPERATURE

(75) Inventors: Georg Henninger, Aachen (DE); Georg Von Blanckenhagen, Aachen (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 204 days.

(21) Appl. No.: 10/542,149

(22) PCT Filed: Dec. 19, 2003

(86) PCT No.: PCT/IB03/06295

§ 371 (c)(1),
(2), (4) Date: Jul. 12, 2005

(87) PCT Pub. No.: WO2004/064107

PCT Pub. Date: Jul. 29, 2004

(65) Prior Publication Data

US 2006/0152155 A1 Jul. 13, 2006

(30) Foreign Application Priority Data

Jan. 15, 2003 (EP) ..... 03100066

(51) Int. Cl.
*H01J 17/16* (2006.01)

(52) U.S. Cl. ..... 313/635; 313/489; 313/112; 313/113

(58) Field of Classification Search ..... 313/489, 313/635, 112, 113
See application file for complete search history.

(56) References Cited

U.S. PATENT DOCUMENTS 5,017,825 A * 5/1991 Heijnen et al. ..... 313/112
5,287,037 A * 2/1994 Malinowski ..... 313/623

(Continued)

FOREIGN PATENT DOCUMENTS

DE 86 00 642.3 7/1986

(Continued)

*Primary Examiner*—Vip Patel

(57) ABSTRACT

The invention relates to a non-automotive-headlight lamp (1) comprising a lighting element (3) and a transparent bulb (2), which is at least partly equipped with an interference coating (4) for e.g. changing the color or color temperature of the lamp (1), and to a lighting unit (15) comprising such a lamp (1) being mounted in a reflector (12). But the invention is also related to lighting units (15) where the interference coating (4) is not applied to the lamp (1) but to the reflector (12). In these lamps (1) or lighting units (15) light components (8) not appropriately filtered by the interference coating (4) lead to undesired wavelengths in the illumination beam and/or to a compromised color uniformity of the beam. Such light components (8) may stem from missing or insufficient filters on part of the lamp (1), from non-normal incidence of the rays (8) on the filter (4), and, in reflectors (12) with interference coating (4), from direct light (8) not hitting the reflector (12). The invention adds a blocking device (5, 6, 7) to the lamp (1) or lighting unit (15) to substantially prevent these light components (8) to enter the illumination beam. Whereas constructively similar blocking devices (5, 6, 7) are known from automotive headlight lamps for preventing glare their benefits in the context of interference coatings (4) were overlooked in the prior art.

9 Claims, 3 Drawing Sheets

U.S. PATENT DOCUMENTS

| | | | | |
|---|---|---|---|---|
| 5,353,210 | A | | 10/1994 | Strok et al. |
| 5,479,065 | A | * | 12/1995 | Sugimoto et al. ..... 313/113 |
| 5,660,462 | A | * | 8/1997 | Bockley et al. ..... 362/256 |
| 5,676,579 | A | | 10/1997 | Parham et al. |

FOREIGN PATENT DOCUMENTS

| | | | |
|---|---|---|---|
| DE | 8600642 | | 10/1994 |
| EP | 0 460 913 | A2 | 12/1991 |
| EP | 0 460 913 | A3 | 12/1991 |
| EP | 0 986 093 | A1 | 3/2000 |
| EP | 1168417 | | 1/2002 |

* cited by examiner

LAMP AND LIGHTING UNIT WITH INTERFERENCE COATING AND BLOCKING DEVICE FOR IMPROVED UNIFORMITY OF COLOR TEMPERATURE

The invention relates to a lamp comprising a lighting element and a transparent bulb, which is at least partly equipped with an interference coating. Such interference coatings are e.g. used for changing the color appearance of the lamp or for raising its color temperature. Such lamps can, among other things, be mounted in a reflector, and the thus obtained lighting unit may serve for various lighting applications, e.g. shop, home, accent, spot, or theater lighting. Thus, the invention encompasses such lighting units comprising a reflector and an inventive lamp, too.

But the invention also relates to a lighting unit comprising a reflector and a lamp, wherein the reflector is equipped with an interference coating. These lighting units are an alternative for the firstly mentioned lighting unit, in which the lamp carried the interference coating. Accordingly, both embodiments of such units can be used for similar purposes. Moreover, lamps with an interference coating might be used in reflectors with an interference coating, too, these interference coatings supplementing each other. E.g., the lamp's interference coating might transmit only the wavelengths below the blue whereas the reflector's coating might transmit the infrared while reflecting the visible, thus in combination yielding a yellow "cold" light, cold denoting the absence of the infrared.

DE 86 00 642 U1 discloses a lamp carrying an interference coating for changing the lamp's color. The coating is made of alternative ¼λ-layers of a material with relatively low and a material with relatively high refraction index, and can be produced e.g. by vapor deposition or by dipping. The document further discloses several filter designs useful for obtaining a yellow lamp. This color filtering can be further improved by supplementing the interference coating with an additional wavelength-selective absorption filter e.g. made of one or two layers of Fe2O3, Sr2O3, CoO, or CuO, which are preferably separated from the interference coating by an adaptation layer with a relatively low refraction index. In order to avoid a further reciting of this document's disclosure DE 86 00 642 U1 in its entirety is included by reference in this application. Besides the above materials for the additional wavelength-selective absorption filter cited in DE 86 00 642 U 1 other materials can be used as e.g. CoA12 O4.

DE 86 00 642 U1 mentions on p. 2, lines 23-38 that in certain embodiments light generated by the lighting element of the lamp may impinge on the bulb's interference coating at a considerably large non-normal incidence. This e.g. might occur with relatively long bulbs. Such non-normal incidence has the effect that wavelengths, which should be reflected back into the lamp by the interference coating, are partly transmitted, thus influencing the lamp's color appearance. But DE 86 00 642 U1, concentrating on automotive headlight lamps, terms this effect as small and points out that the usage of an additional wavelength-selective absorption filter removes the effect.

EP 0 986 093 A1 re-addresses the problems caused by such non-normal incidence on the interference coating. Whereas also EP 0 986 093 A1 terms this a minor problem for automotive headlight lamps (in column 1, lines 26-30), it points out that lamps in other applications as e.g. for automotive stop lights or beacons have a different construction as e.g. a pear-shaped bulb. In such lamps, the effect of non-normal incidence is not negligible but might e.g. cause the lamp appear in different colors at different viewing angles respectively might cause the lamp generate colored lighting patterns on the illuminated object area.

To solve these problems EP 0 986 093 A1 refers to the method disclosed in EP 0 460 913 A2 of using a locally varying thickness of the interference coatings of the lamp and of the reflector the lamp is mounted into to avoid ring-shaped colored lighting patterns. EP 0 986 093 A1 then further develops this method by giving prescriptions on how to determine the local thickness of the interference coating. Again, to avoid further reciting the disclosure of EP 0 986 093 A1, as e.g. concerning concrete filter embodiments and production methods, this document in its entirety is included by reference in this application.

Whereas varying the local thickness of an interference coating according to EP 0 986 093 A1 offers a solution to the problems caused by non-normal incidence this method causes a considerable increase in production complexity and costs. Moreover, due to production constraints there may be parts of the lamp's bulb that carry no or only an insufficient interference coating leading to not or at least insufficiently filtered light components. E.g., the pinch part of the bulb might be sandblasted after the interference coating was applied, such sandblasting removing the interference coating on the pinch. In the same way, on strongly curved parts of the bulb the interference might be badly defined, e.g. in the transition region between pinch and middle part of the bulb or at the top of a single-ended lamp. In this later case, of course, also the problem of non-normal incidence arises concurrently. In a lighting unit, in which the reflector carries an interference coating the light directly leaving the lighting unit, i.e. the light generated by the lighting element of the lamp and directed towards the open end of the reflector, is not filtered by this interference coating and thus adds undesired wavelengths in the lighting unit's beam.

All these phenomena of non-normal incidence, missing or badly defined interference coatings, and direct light have in common that light components not having been appropriately filtered by the interference coating appear in the illumination beam. Such components lead to undesired wavelengths in the illumination beam and/or compromise the illumination beam's color uniformity.

It is therefore an object of the invention to provide, in the realm of non-automotive-headlight lamps and in the realm of reflector lighting units, a simple and cheap solution at least alleviating to a large extent the problems of undesired wavelengths and insufficient color uniformity caused by inappropriately filtered light components in the illumination beam.

The first object is achieved by a non-automotive-headlight lamp comprising a transparent bulb, a lighting element inside the bulb, an interference coating on at least part of the bulb, and a blocking device being designed for blocking at least part of the rays generated by the lighting element and not appropriately filtered by the interference coating (4).

The term "non-automotive-headlight" is used in the sense of a disclaimer for establishing novelty over the prior art, i.e. a "non-automotive-headlight lamp" denotes any lamp with the exception of a lamp constructed for use in a car headlight.

As already pointed out in the introductory section such a lamp might be mounted in a reflector to form a lighting unit. Thus, the invention also relates to a lighting unit comprising a reflector, and a non-automotive-headlight lamp according to claim 1 mounted within the reflector.

In such a lighting unit, the blocking device might be constructed not as a part of the lamp but as a separate shield. Accordingly, the invention additionally encompasses a non-automotive-headlight lighting unit comprising a reflector, a shield, a lamp mounted within the reflector, the lamp comprising a transparent bulb, a lighting element inside the bulb, and an interference coating on at least part of the bulb, wherein the shield is designed for absorbing at least part of the rays generated by the lighting element and not appropriately filtered by the interference coating (4).

Moreover, as also pointed out in the introductory section, instead of coating the lamp with an interference filter the reflector might be coated. Therefore, the second object of the invention is achieved by a lighting unit comprising a reflector with an interference coating, a lamp mounted within the reflector, and a blocking device being designed for blocking at least part of the rays generated by the lamp and being directed to the open end of the reflector.

Of course, as is obvious to the skilled man and e.g. mentioned in EP 0 986 093 A1, lamp and reflector interference coatings might be combined in one lighting unit.

Thus, the invention relies on the insight that a simple and cost efficient solution for at least alleviating to a large extent the problems caused by inappropriately filtered light components consists in blocking these light components from reaching the illumination area. I.e., that part of the light is blocked, which otherwise would not pass any interference filter, would only pass an insufficient filter, or would pass the filter at non-normal incidence.

It has to be pointed out that lamps, which carry an interference coating on their bulbs and possess a non-transparent coating on their top, are well known for automotive-headlight applications. E.g., the lamp shown in the figure of DE 86 00 642 U1 and discussed therein is of such a type. The document explicitly mentions on p. 4, lines 10-16 that the lamp is thought to be mounted in a reflector for generating a low beam ("Abblendbündel") and a high beam ("Hauptbündel"), which clearly classifies the lamp for the use in an automotive headlight. Furthermore, as a specific example, the document mentions a yellow H4-automotive-lamp.

But the existence of these prior-art automotive headlight lamps has to be clearly distinguished from the invention at issue: The non-transparent coatings on the tops of automotive headlight lamps, usually termed as bulb, capsule, or black caps, serve the sole purpose of regulating the luminance of the headlight in order to prevent glaring the other traffic participants by the direct light of the lamp's lighting element. These caps were known prior to the introduction of interference coatings and the art prior to the invention at issue did not recognize the beneficial effects of such blocking devices for the claimed purposes of reducing inappropriately filtered light components of an interference-coated lamp or lighting unit.

That the prior art actually overlooked the claimed beneficial effects is e.g. obvious from the already cited passages of DE 86 00 642 U1 and EP 0 986 093 A1 terming the problems caused by non-normal incidence small or minor for automotive headlight lamps and from the fact that EP 0 986 093 A1, while knowing about the caps of automotive headlight lamps, developed another solution for this problem, i.e. developed further the idea of a locally varying thickness of the interference coating.

An inventive lamp might be a light source of any kind, i.e. encompasses halogen lamps as well as discharge lamps and might further comprise other light sources, too, e.g. ones utilizing chemical effects, the only prerequisite being that the light source emits a light 'spectrum, which can be usefully filtered by an interference coating. Accordingly, an inventive lamp's lighting element denotes that part of the lamp emitting the light thought to be filtered by the interference coating, e.g. the filament of an incandescent lamp, the arc of a high-pressure discharge lamp, or the phosphors converting the ultraviolet light generated in a fluorescent lamp.

An interference coating on the bulb of an inventive lamp or on a reflector may be of any type transmitting one part of the spectrum and reflecting the other. The design and production of such filters is nowadays state-of-the-art and examples of filters transmitting the wavelengths in the yellow, the orange, or the red are given e.g. in DE 86 00 642 U1 or EP 0 986 093 A1. But besides changing the color of a lamp such interference coatings might as well be designed for making the lamp more daylight like, i.e. for raising its color temperature, or for increasing their energy efficiency respectively at least partly avoiding undesired heating of the illumination area by reflecting back the infrared into the lamp. The later effect, i.e. obtaining "cold" light can also be obtained by coating the reflector the lamp is mounted into and having this reflector transmit the infrared while reflecting the visible.

The blocking device might perform its function by absorbing or reflecting the light impinging on it or by a mixture thereof. Reflection offers the advantage of increasing the efficiency of the lamp or lighting unit: In an incandescent lamp, the reflected light at least partially heats the filament. In a lighting unit whose reflector carries an interference coating, the light reflected by the blocking device hits the reflector and its interference coating and thus contributes to a large extent to the illumination beam.

The blocking device might e.g. be realized as a shield, mounted as part of the lamp or as a separate element, a cap, e.g. made of an absorbing or mirroring metal and mounted on the bulb, covering part of it, or as a non-transparent coating on part of the bulb, e.g. of the same type as known from the automotive headlight lamps, e.g. a black cap made of standard silicon iron oxide black. In principle, the blocking could also be achieved by using a non-transparend material for the bulb at the appropriate positions, e.g. manufacturing the bulb's ends of a non-transparent material, using a transparent one only for the bulb's middle part.

The blocking device is to be provided at a position where it blocks at least part of the light, which contains the inappropriately filtered light components. Thus, for blocking the direct light of a lamp being mounted in a reflector it has to block the light being directed from the lighting element to the reflector opening. In this way, besides suppressing inappropriately filtered light components, the blocking device at the same time serves the purpose of preventing glare from this direct light.

The problems of non-normal incidence are e.g. prominent with long lighting elements being mounted transversely to the lamp's axis of cylindrical symmetry, with elongated bulb forms as well as with bent bulb shapes. Common examples are low-voltage halogen lamps for home lighting. These lamps are single-ended, i.e. their electrical contacts leave the lamp on one side, whereas at the opposing side the lamps' walls terminate in a concave rounding and finally in a convex top, necessarily leading to considerable non-normal incidence of the lighting element's light, and additionally showing the problems of a badly defined interference coating on the strongly curved parts of the bulb's top. An effective blocking element according to the invention for such a lamp consists in a non-transparent coating or a cap covering the lamp's top, i.e. their end opposing the electrical contacts.

While the above aspects of the invention have mostly been discussed in isolation it is obvious to the skilled man that they may also be used in combination as well as being combined with further measures. E.g., interference coatings in a lighting unit may be employed on the lamp as well as on the reflector, the lamp's coating transmitting wavelengths below the blue and the reflector's coating transmitting the infrared, thus in combination yielding a yellow "cold" light. Furthermore, additional wavelength-selective absorption coatings may assist the interference coatings as e.g. disclosed in DE 86 00 642 U1.

Inventive lighting units may be designed for various applications, dependent on the type of the lamp and the filter curve of the interference coating. Some of the envisaged applications are shop lighting, home lighting, accent lighting, spot lighting, theater lighting, fiber-optics applications, and projection systems in general.

These and further aspects and advantages of the invention will be further illustrated by the embodiments and, in particular, by the description of the attached figures.

Figure 1:
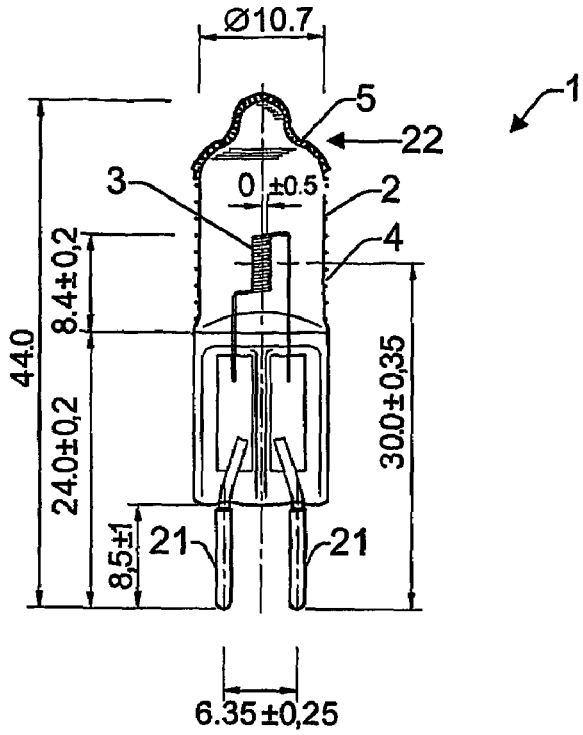
FIGS. 1 to 3 show sectional views of embodiments of an inventive non-automotive-headlight lamp.

FIG. 1 shows a first embodiment of an inventive non-automotive-headlight lamp 1, in which the parts most relevant for the invention are equipped with reference numerals and exemplary dimensions are given in millimeters partly together with their tolerances. But lamp 1 might as well be manufactured with differing dimensions. Lamp 1 is a single-ended halogen incandescent lamp, which can e.g. be inserted into a reflector and used for shop or home lighting. It is operated at a voltage of 12 V with a power of 50 W but might as well be designed to being operated at other low voltages as e.g. 6 V and 24 V or might also be designed for mains voltages as e.g. 110 V and 220 V. Single-ended means that both electrical contacts 21 leave lamp 1 on one side only. The side opposed is termed as the top 22 of lamp 1. Lamp 1 further comprises a light-transparent bulb 2, which is coated on its outer side with an interference coating 4, indicated in FIG. 1 by a dashed line. The lighting element 3 of lamp 1 is a tungsten filament formed as a coil.

Caused by its production process, the top 22 of bulb 2 consists of several concave and convex parts, necessarily leading to considerable non-normal incidence of the lighting element's light. To block this light from leaving lamp 1 top 22 is coated on the outside of interference coating 4 by a non-transparent coating 5 functioning as a blocking device, which might be produced e.g. by a dipping or sputtering process. Coating 5 might e.g. consist of standard silicon iron oxide black absorbing the light impinging on it as well as might be constructed as a mirror reflecting the impinging light back into lamp 1. Of course, as interference coating 4 has no function on top 22 it might there be omitted completely or non-transparent coating 5 might be provided between bulb 2 and interference coating 4, whichever is more suitable for the production process at hand.

But in case of a reflective coating 5 as blocking device it is more advantageous to provide reflective coating 5 beneath interference coating 4 or to omit interference coating 4. In this case part of the light being reflected by reflective coating 5 is re-absorbed at filament 3, thus heating filament 3 and saving some energy input to lamp 1. Moreover, dependent on the lamp's geometry, some other part of the light being reflected by reflective coating 5 can leave lamp 1 at another place of bulb 2 passing there interference coating 4 at substantially normal incidence. But in this latter case care has to be taken that not too much reflected light leaves lamp 1 at positions where it passes interference coating 1 at non-normal incidence.

Figure 2:
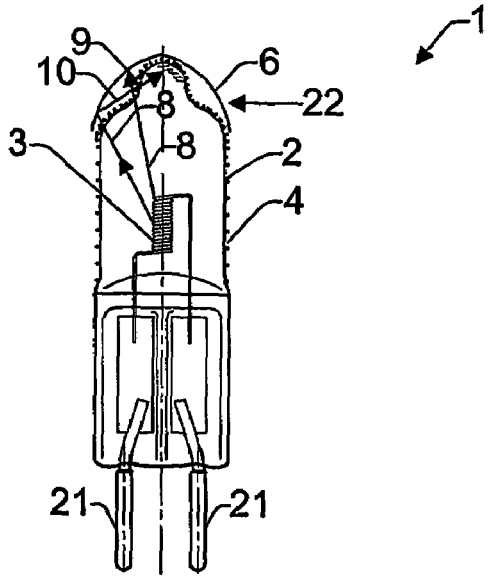

FIG. 2 shows a second embodiment of an inventive non-automotive-headlight lamp, which coincides with FIG. 1 with the exception that the blocking device is formed as a non-transparent cap 6. Cap 6 can e.g. be mechanically attached to bulb 2 by pressing it into close contact to bulb 2 or can be glued to bulb 2. For illustration, FIG. 2 shows two light rays 8 being generated by lighting element 3 and hitting interference coating 4 at non-normal incidence. Exemplifying, one of rays 8, i.e. ray 9, is drawn as being absorbed by a black, absorbing cap 6, while the other of rays 8, i.e. ray 10, is drawn as being reflected by a reflecting, e.g. mirror covered cap 6.

Figure 3:
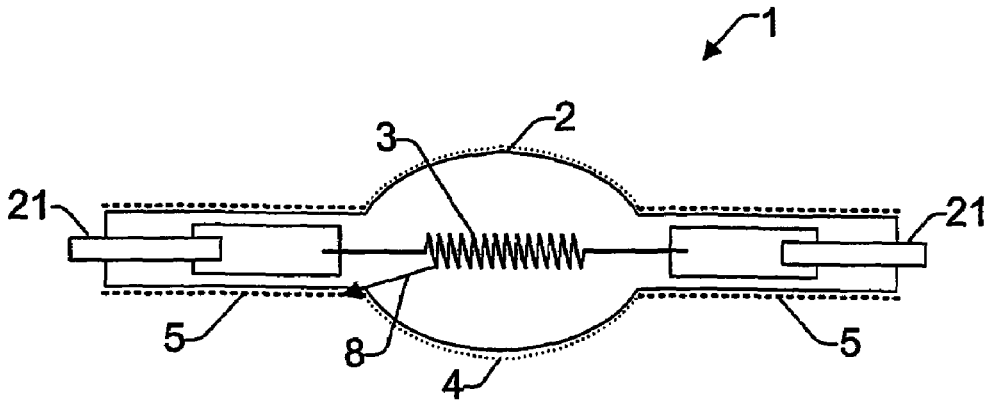

FIG. 3 shows a third embodiment of an inventive non-automotive-headlight lamp, which shows a two-ended incandescent lamp 1 with bulb 2, electrical contacts 21, filament 3 as lighting element, and interference coating 4 on the middle part of the bulb 2. In some production processes will the outer, pinched parts of the bulb 2 be sandblasted which sandblasting destroys a possible prior interference coating on these outer parts. In order to avoid unfiltered light to leave lamp 1 via these outer parts they have been coated by an absorption coating 5 as blocking device. Thus, ray 8 from filament 3 otherwise leaving lamp 1 and adding an undesired component to the illumination beam now will be absorbed by blocking device 5. Of course, if lamp 1 is to be used within a reflector the pinched part of bulb 2 inserted into the reflector's neck need not be coated with absorption coating 5 as the light directed to that part will be absorbed within the reflector's neck anyhow.

Figure 4:
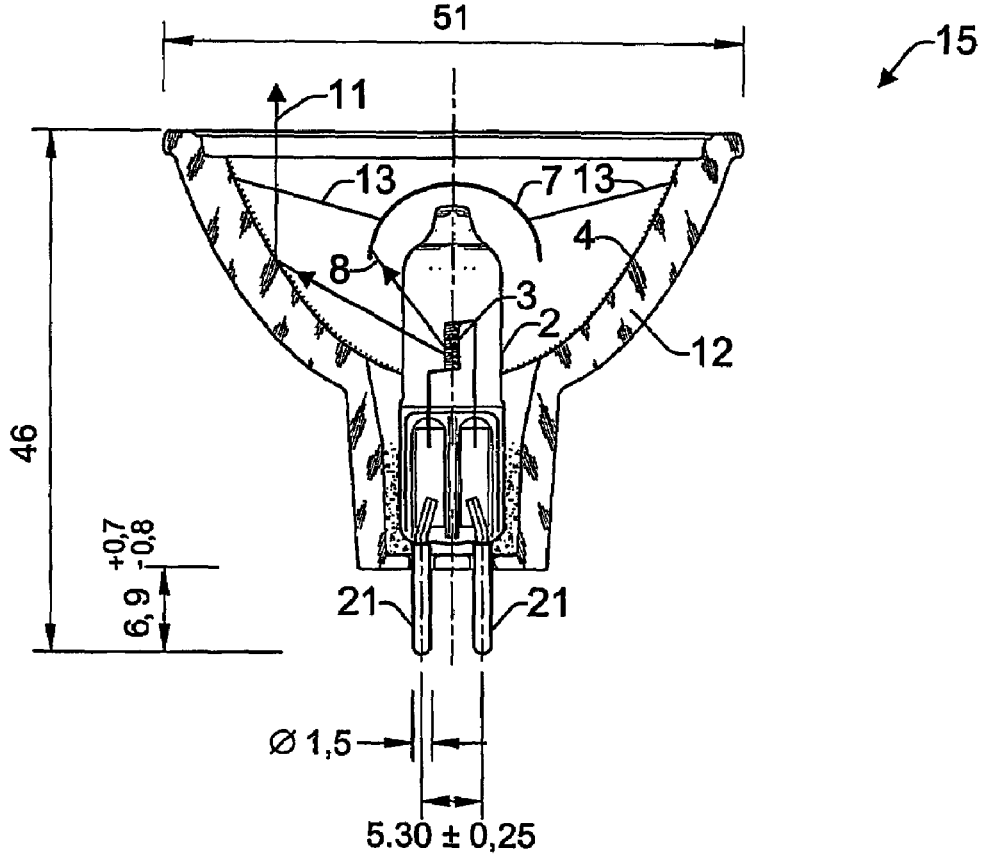
FIGS. 4 and 5 show sectional views of embodiments of an inventive lighting unit.

FIG. 4 shows a first embodiment of an inventive lighting unit 15 with exemplary dimensions given in millimeters. A lamp is mounted within a reflector 12, which carries on its inner side an interference coating 4, shown as a dotted line. The reference numerals 21 denote the lamps electrical contacts, 2 its bulb, and 3 its lighting element. A shield 7, fixed by plates 13 to the reflector 12, serves as a blocking element for the light of the lighting element 3 being directed to the open end of reflector 12. For illustration, one of these light rays 8 is shown, impinging on shield 7 and being absorbed there. The light 11 of lighting element 3 being directed to the inner side of reflector 12 is reflected there into the reflector's main beam while being filtered by interference coating 4.

Figure 5:
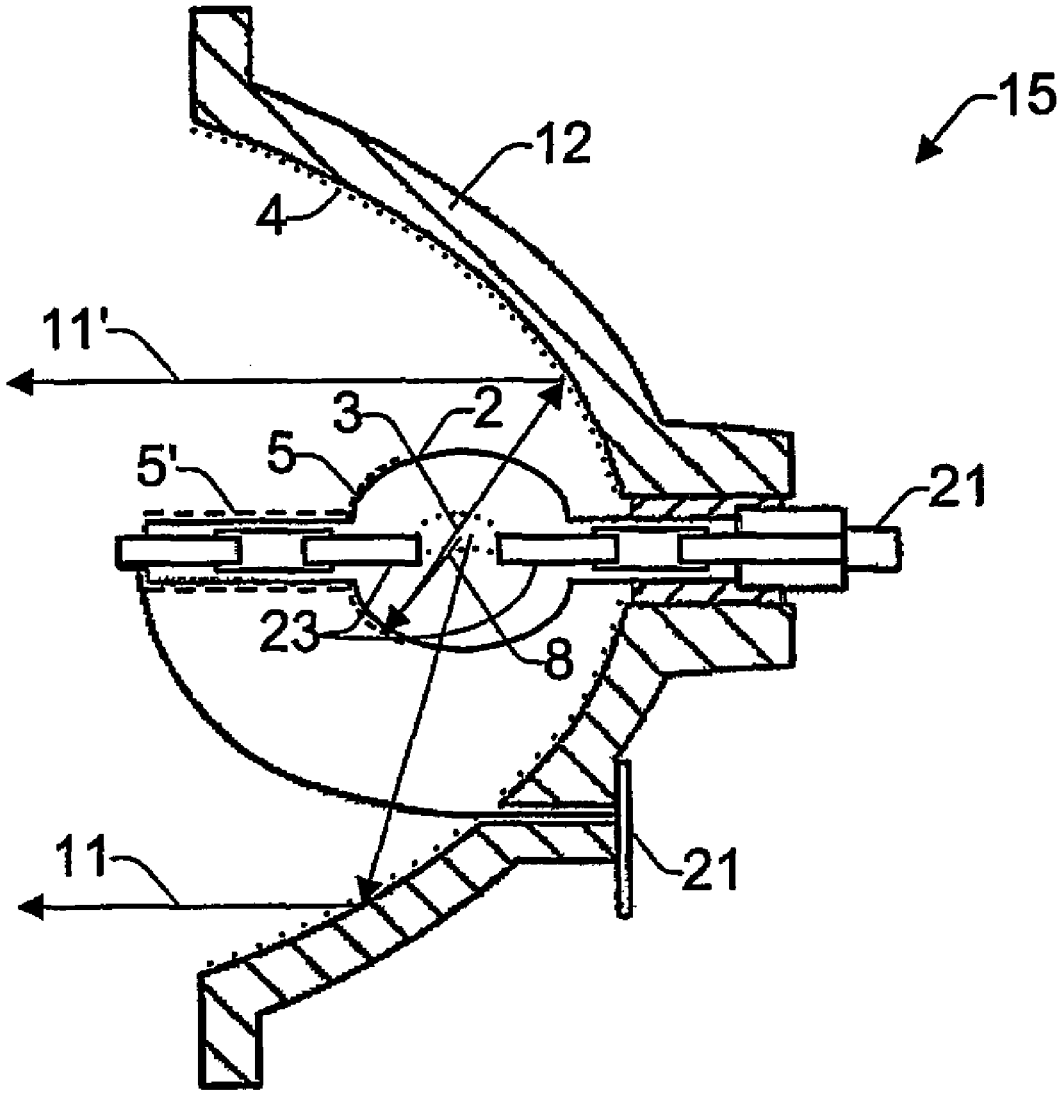

FIG. 5 shows a second embodiment of an inventive lighting unit 15, again showing a lamp being mounted in a reflector 12, the reflector 12 carrying on its inner side an interference coating 4. But whereas in FIG. 4 a one-sided incandescent lamp was used FIG. 5 shows a two-sided high-pressure gas discharge lamp, whose electrical contacts 21 are lead to the rear side of reflector 12. The lighting element 3 is now realized as an arc 3 burning between the electrodes 23 inside the bulb 2 of the gas discharge lamp. Now, a reflecting coating 5 on the middle part of bulb 2 and an absorbing coating 5' on the outer, pinchec part of bulb 2, both parts being directed to the open side of reflector 12, block the direct light of lighting element 3. Thus, not just the light rays 11 being directed from arc 3 to reflector 12 form the illumination beam but also the light rays 8, after reflection at reflection coating 5, hit reflector 12 passing its interference coating 4 and contribute as rays 11' to the illumination beam. Rays being directed from arc 3 to the outer, pinched part of bulb 2 at the reflector's open side, which otherwise would add undesired wavelengths to the illumination beam, are absorbed by absorbing coating 5'.

In the situations of FIGS. 4 and 5 where the reflector 12 carries the interference filter 4 it might be advantageous to equip the bulb 2 of the lamp with an additional filter that in itself might be an interference filter, too. E.g., if the interference filter 4 of reflector 12 is designed for raising the color temperature of the reflected light, e.g. to make it more daylight like, bulb 2 of the lamp can be provided with an infrared reflecting (IR) interference filter. Such an IR filter will reflect the infrared back into the lamp acting as additional energy source heating filament 3 of an incandescent lamp or the discharge of a discharge lamp thus saving some of the energy input to the lamp.

The invention claimed is:

1. A non-automotive-headlight lamp comprising:

a transparent bulb, a lighting element inside the bulb, the lighting element configured to generate light rays, an interference coating on at least part of the bulb, and a blocking device coupled to the bulb and configured to block at least part of the rays (i) generated by the lighting element and (ii) not appropriately filtered by the interference coating, wherein the blocking device blocks by absorption of a part and reflection of a remaining part of the rays impinging on the blocking device.

2. A non-automotive-headlight lamp according to claim 1, wherein the lamp is adapted to be mounted in a reflector having an open end, and the blocking device is further configured to block at least part of the rays generated by the lighting element and being directed to the open end of the reflector.

3. A non-automotive-headlight lamp according to claim 2 wherein the lamp is double-ended, and the blocking device comprises an absorbing coating covering an outer pinched portion of the bulb of the lamp, and a reflective coating on a middle portion of the bulb of the lamp, both the absorbing coating and the reflective coating being directed to the open end of the reflector.

4. A non-automotive-headlight lamp according to claim 1, wherein the interference coating is further configured to raise the color temperature of the light emitted by the lighting element, and/or change the color of the light emitted by the lighting element.

5. A non-automotive-headlight lamp according to claim 1, wherein the lamp comprises an additional wavelength-selective absorption coating adapted to support the filtering characteristics of the interference coating.

6. A lighting unit comprising a reflector, and a non-automotive-headlight lamp according to claim 1 mounted within the reflector.

7. A lighting unit according to claim 6 the lighting unit further being configured to be used in one of the following applications:

shop lighting, home lighting, accent lighting, spot lighting, theater lighting, fiber-optics applications, and projection systems.

8. A non-automotive-headlight lighting unit comprising a reflector, a shield coupled to the reflector, a lamp mounted within the reflector, the lamp comprising a transparent bulb, a lighting element inside the bulb the lighting element configured to generate light rays, and an interference coating on at least part of the bulb, wherein the shield is configured to block at least part of the rays (i) generated by the lighting element and (ii) not appropriately filtered by the interference coating.

9. A lighting unit comprising a reflector with an interference coating, the reflector including an open end, a lamp mounted within the reflector, the lamp configured to generate light rays, and a blocking device (i) configured to block at least part of the rays generated by the lamp and (ii) being directed to the open end of the reflector, wherein the blocking device is configured to block by absorption of a part and reflection of a remaining part of the rays impinging on the blocking device.

* * * * *